US006164102A

United States Patent [19]

Gapco

[11] Patent Number: 6,164,102

[45] **Date of Patent: *Dec. 26, 2000**

[54] KEY HANDLE

[76] Inventor: Brian E. Gapco, 1185 Timberview Trail, Bloomfield Hills, Mich. 48304

[ * ] Notice: Under 35 U.S.C. 154(b), the term of this patent shall be extended for 562 days.

[21] Appl. No.: 08/523,330

[22] Filed: Sep. 5, 1995

Related U.S. Application Data

[63] Continuation of application No. 08/181,818, Jan. 18, 1994, abandoned.

[51] Int. Cl.[7] ..... E05B 19/04

[52] U.S. Cl. ..... 70/408; 70/456 R

[58] Field of Search ..... D3/204–212; 70/408, 70/456 R

[56] References Cited

U.S. PATENT DOCUMENTS

| | | | |
|---|---|---|---|
| D. 286,465 | 11/1986 | Attwood | D3/211 |
| 1,548,287 | 8/1925 | Sharp . | |
| 1,914,318 | 6/1933 | Yankioitch | 70/456 R |
| 1,936,273 | 11/1933 | Segal . | |
| 1,974,547 | 9/1934 | Slade | 70/456 R |
| 1,999,290 | 4/1935 | Goessling . | |
| 2,003,553 | 6/1935 | Root . | |
| 2,006,286 | 6/1935 | Waller | 70/456 R |
| 2,105,763 | 1/1938 | Berry | 70/456 R |
| 2,180,717 | 11/1939 | Nelson | 70/456 R |
| 2,306,970 | 12/1942 | MacPherson et al. . | |
| 2,684,096 | 7/1954 | Snell . | |
| 2,764,202 | 9/1956 | Jackson . | |
| 3,209,479 | 10/1965 | Manzardo . | |
| 3,315,505 | 4/1967 | Shelton | 70/456 R |
| 3,354,679 | 11/1967 | LeFave . | |
| 3,355,917 | 12/1967 | Albert | 70/456 R |
| 3,427,834 | 2/1969 | Tutino | 70/456 R |
| 3,613,414 | 10/1971 | Ostrager | 70/456 R |
| 3,680,338 | 8/1972 | Lee | 70/456 R |
| 4,035,865 | 7/1977 | McRae et al. | 16/114 R |
| 4,312,200 | 1/1982 | Thomas | 70/408 |
| 4,475,367 | 10/1984 | Raitto | 70/456 R |
| 4,557,123 | 12/1985 | Marks | 70/456 R |
| 4,557,124 | 12/1985 | Russ . | |
| 4,583,383 | 4/1986 | Bosco et al. | 70/458 |
| 4,637,238 | 1/1987 | Uda et al. | 70/456 R |
| 4,646,913 | 3/1987 | Wing et al. . | |
| 4,768,362 | 9/1988 | Schmalz, Jr. | 70/408 |
| 4,783,883 | 11/1988 | Szalay . | |
| 4,826,002 | 5/1989 | Matuura . | |
| 4,881,636 | 11/1989 | Oletzke . | |
| 4,910,983 | 3/1990 | Taylor | 70/408 |
| 5,033,141 | 7/1991 | Kang | 70/456 R |
| 5,058,465 | 10/1991 | Womack | 70/408 |
| 5,226,252 | 7/1993 | Haluska | 70/456 R |
| 5,261,257 | 11/1993 | Collier | 70/456 R |
| 5,435,160 | 7/1995 | Linsalato et al. | 70/408 |
| 5,487,291 | 1/1996 | Voigt | 70/456 R |

FOREIGN PATENT DOCUMENTS

| | | | |
|---|---|---|---|
| 2107846 | 3/1972 | United Kingdom | 70/456 R |

*Primary Examiner*—Anthony Knight
*Assistant Examiner*—Clifford B Vaterlaus
*Attorney, Agent, or Firm*—Brian E. Gapco

[57] ABSTRACT

A bulbous hand grip facilitates the turning of a key within a lock by increasing the turning radius through which the key is turned, as well as providing finger and hand surfaces which may be utilized during turning. The hand grip may include a substantially arcuate or spheroidal surface contour. The key may be secured within the hand grip by elastic deformation forces and/or by conventional fasteners.

11 Claims, 2 Drawing Sheets

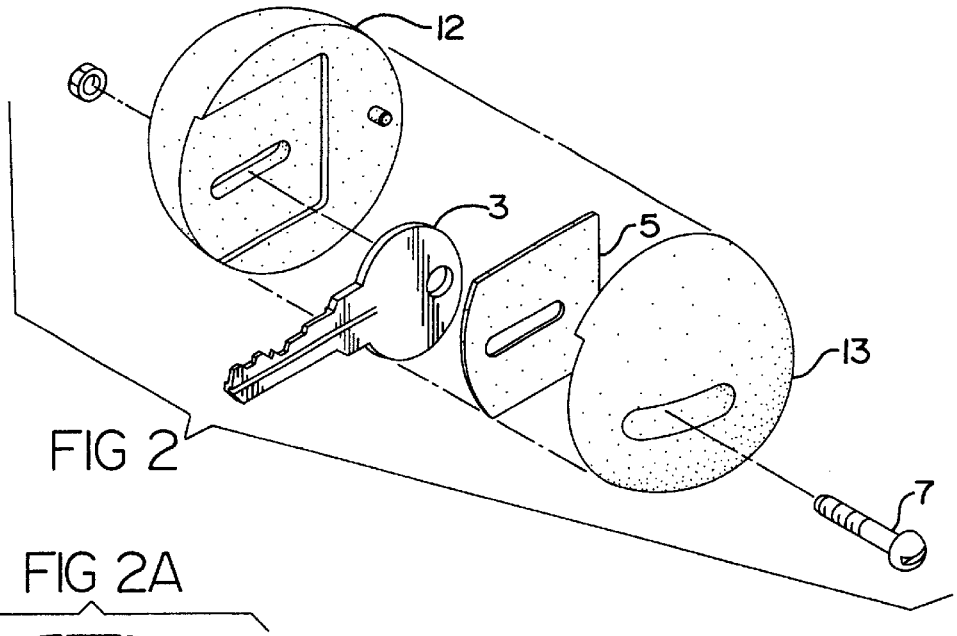
FIG 2
FIG 2A
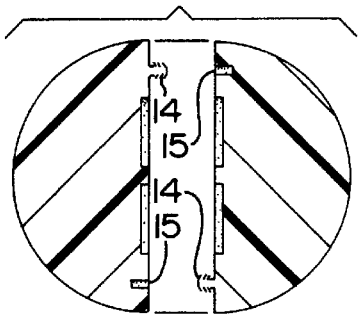
FIG 1B
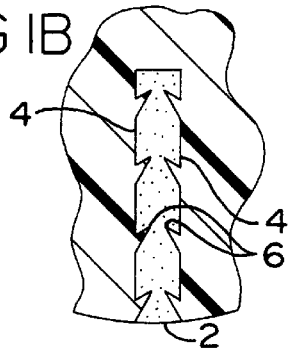
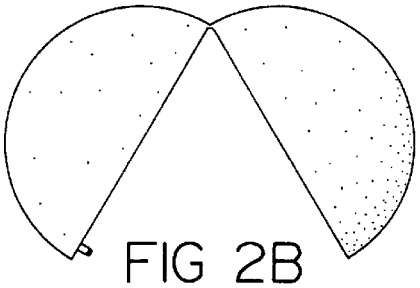
FIG 2B
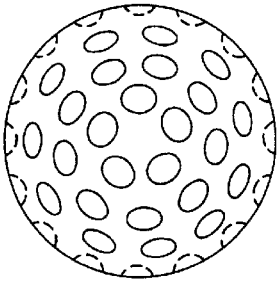
FIG 4B
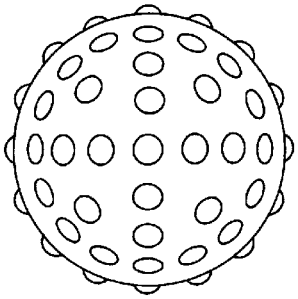
FIG 4C
FIG 3
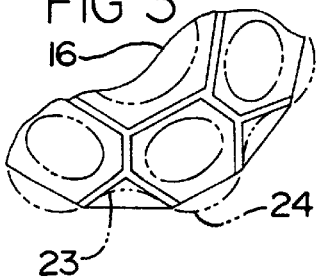
FIG 4
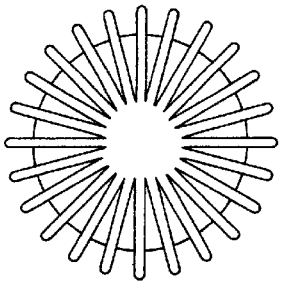
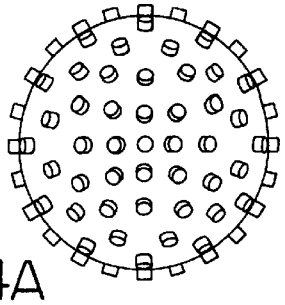
FIG 4A

KEY HANDLE

This is a continuation of application Ser. No. 08/181,818, filed Jan. 18, 1994 now abandoned.

BACKGROUND OF THE INVENTION

1. Field of the Invention

The present invention relates to handles, and specifically to handles or grips which are attachable to keys to facilitate their use.

2. Description of Prior Developments

Keys of the type widely used for operating locks found in the doors of homes, offices, vehicles and other applications are generally planar or laminal in form. Such keys typically include a base, which is often perforated and which provides a surface for gripping and turning the key, and an integrally formed shaft projecting from the base. Integrally formed on the shaft is a series of irregularities, such as teeth, which are configured to correspond to the mating elements of the lock when inserted therein.

The act of gripping and turning the key base requires the pads of several fingers to be placed together in close proximity in a pincer-like or pinching fashion. The planar form of the key and key base is not chosen primarily for ease of use but to enable inexpensive manufacture, coding and compact storage of several keys as on a single key ring.

In general, prior key holders included various key attachments for containing one or more keys and for aiding in identifying and selecting individual keys. These prior attachments take advantage of the compact planar form of the typical key by making the key cases and holders substantially planar as well.

Prior key cases and holders are typically made laminal as suggested by the flat keys with which they are used. Also transferred from the key to the key holder is the requirement that the key user's fingers assume a pincer-like position to grip and twist the device holding the key. Arthritis and other debilitating medical conditions can impair digital dexterity and cause such a pinching, twisting action to be painful, awkward or even impossible to perform.

Many devices, such as eating utensils and writing instruments, have been specifically designed to minimize discomfort and enable their usage by persons afflicted as mentioned above. However, there yet appears to be a need for a device to allow the easier use of a common key.

The act of pinching a planar object often causes longer fingernails to come into contact with one another, the key, the lock or an adjacent object. This contact can damage or ruin any cosmetic treatment which has been applied to the fingernails or cuticles.

SUMMARY OF THE INVENTION

Accordingly, it is an object of the present invention to provide a key grip with which the required grasping and turning action can be accomplished with the hand in a more relaxed and comfortable position and which allows the action to be performed using a greater area of the fingers as well as the palm of the hand, thereby reducing the required gripping effort.

A further object of the invention is the reduction of the tangential or twisting forces required to turn a key by virtue of increasing the turning radius upon which the fingers and palm act.

Still another object of the invention is to preclude the necessity or minimize the possibility of bringing the fingertips and fingernails into close proximity with one another and with other objects which, if touched, would damage the surface or edge of the fingernail.

Yet another object of the invention is to allow a plurality of attachment positions to accommodate different key sizes, hole locations and lock configurations.

A further object of the invention is to allow the pivotable mounting of the key with respect to the handle.

Still another object of the invention is to provide surface discontinuities to enable still easier grasping and turning of the handle.

An additional object of the invention is to provide a hole or ring to allow attachment of the invention to a conventional keyring or keychain.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 1B is a sectional view of the slot of a second unitary embodiment of the invention.

FIG. 2 is an exploded view of a two-piece embodiment of the invention.

FIG. 2A is a sectional view of a second two-piece embodiment.

FIG. 2B is a perspective view of a hinged, one-piece embodiment of the invention.

FIG. 3 is a sectional view of a polyhedral embodiment of the invention showing concave and convex polyhedral surfaces.

FIGS. 4, 4A, 4B and 4C are views of embodiments of the invention employing surface discontinuities.

In the various figures of the drawings, like reference characters designate like parts.

DETAILED DESCRIPTION OF THE PREFERRED EMBODIMENTS

Figure 1:
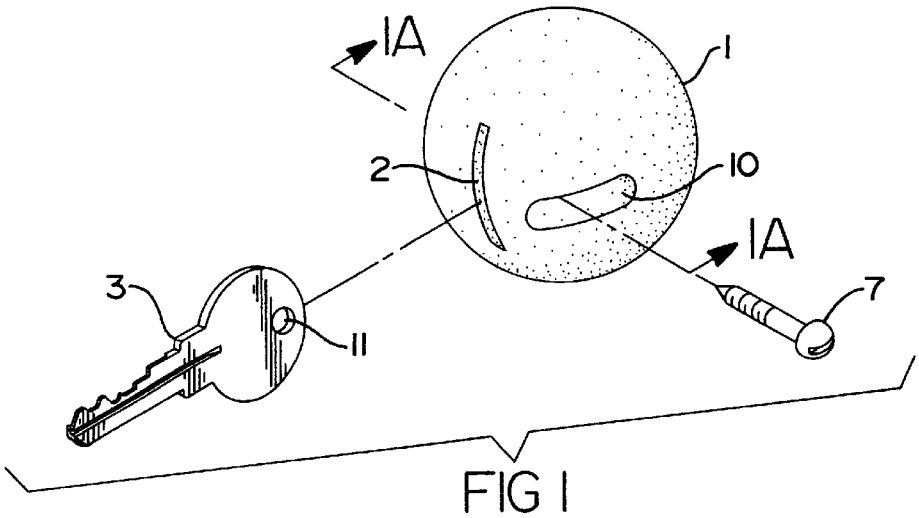
FIG. 1 is a perspective view of a unitary handle embodiment of the invention.

FIG. 1 shows a basic version of a substantially completely spheroidal key handle or grip constructed in accordance with the present invention. The handle is illustrated as a sphere or spheroid 1 composed of a solid, preferably resilient material such as plastic or rubber. The handle may be symmetric about its axis of rotation or may be asymmetric, as the user may find ergonomically desirable. The material may vary in hardness to the preference of the user, but a high coefficient of friction to enable easy grasping of the handle is usually desirable.

Figure 1A:
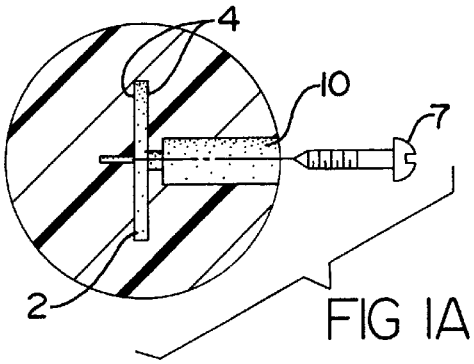
FIG. 1A is a sectional view of FIG. 1 taken along line 1A—1A of FIG. 1.

As shown in FIG. 1, oriented along a meridian of spheroid 1 is a slot 2 designed to accommodate the base of a key 3 to be attached to the handle. The slot, which is formed as a recess in a front portion of the spheroid body may be oriented toward the center of the handle or offset from it. If a sufficiently compliant material is used, the walls 4 adjacent to the slot 2, as shown in FIG. 1A, may be partially or entirely in contact or tangent to one another before the insertion of the key base into the slot. This wall contact results in the resilient, biased gripping of the key base as the key resiliently separates the walls 4 as the key is forced between the walls of the slot. Additionally, as shown in FIG. 2, the walls which extend along the slot provide a torque transmitting key attachment structure and may be coated or lined with an adhesive or yielding substance 5, such as double-sided adhesive foam tape, to improve retention and stability of the key base within the key slot. The rear hemispherical portion of the spheroid body opposite the slotted front portion provides a hand engagement surface.

Also, a thermoexpansive material or arrangement of materials may be used in the slot area or for the entire handle, this allowing easier insertion of a key when the handle is cooled as in the freezer compartment of a common refrigerator, but providing increased clamping or retention force when the handle assembly is allowed to return to room temperature.

As shown in FIG. 1B, a series of resilient directional or nondirectional ridges 6, teeth or the like can be inwardly oriented from each wall to allow easy insertion of the key base into the slot, yet provide firm hook-like key retention and require significantly higher force and/or deformation of the slot to remove the key.

Figure 1C:
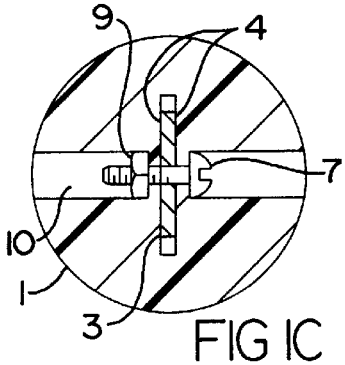
FIG. 1C is a third unitary embodiment of the invention.

Although such an interference retention of the key base within the slot may alone be sufficient, additional gripping or retention may be desirable. For example, in FIGS. 1 and 1C, screw 7 may be inserted through hole 10 which runs perpendicular to the plane of slot 2. Key base 3 is then inserted into slot 2 so that a perforation 11 is axially aligned with hole 10. Hole 10 may be elongated as shown to allow for a plurality of attachment locations. The screw 7 is then passed through perforation 11 and continues through hole 10 until it emerges on an exposed surface of or groove in spheroid 1 where a nut 9 may be applied and tightened to provide a clamping force for retention of the key. Hole 10 could also be tapped to receive screw 7 or a self-tapping screw may be used as in FIG. 1A. Such embodiments also allow the pivoting of the key base 3 about screw 7. Of course, many different types of fasteners may be used.

FIG. 2 shows an exploded view of a two-part embodiment in which two hemispheric sections 12,13 enclose the base of the key 3 when fastened together over it. Barbed projections 14 extending from the symmetric hemispheric sections can be used to retain the section together by mating with corresponding holes 15, as could conventional fasteners. The hemispheric sections can be hinged as well, as shown in FIG. 2B.

FIG. 3 shows a sectional view of a handle 16 in the form of a polyhedron displaying six or more sides. Embodiments with concave 23 and convex 24 meniscus faces are also shown in phantom.

FIGS. 4, 4A, 4B and 4C show two configurations of surface irregularities. FIG. 4 shows meridional fins of varying depths. FIG. 4A shows an array of nubs or projections located on the surface of the handle. FIG. 4B shows a series of depressions. FIG. 4C shows a series of convex projections.

Figure 5:
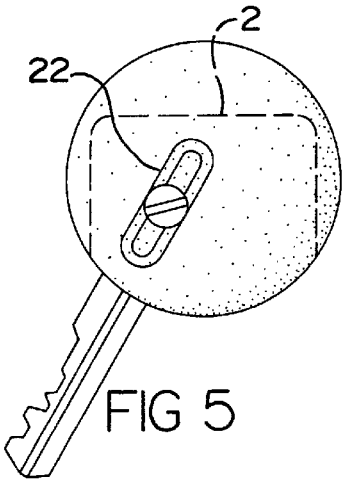
FIG. 5 is a side view showing an embodiment of the invention with adjustable attachment positions.
Figure 7A:
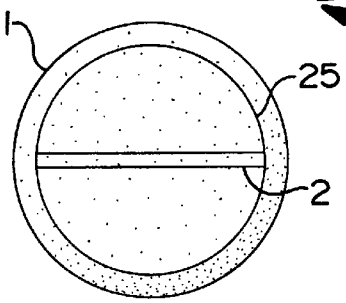
FIG. 7 is a side view showing a truncated embodiment with adjustable attachment positions.
Figure 7:
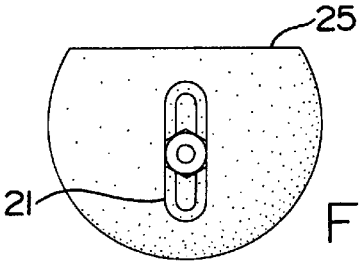

FIGS. 5 and 7 show two additional embodiments of the invention which allow for variable positioning of the attachment point of the fastener and, thus, attachment of the key with respect to the handle. FIG. 7 includes a planar surface portion or truncation 25 with a slot formed in the planar surface portion of the handle in which slot 21 is straight. FIG. 7A shows a top plan view of the handle of FIG. 7, including slot 2 in planar surface portion 25. Slot 22 in FIG. 5 is angled with respect to the centerline of slot 2, shown in phantom, to provide a yet higher degree of variability in positioning.

Figure 6:
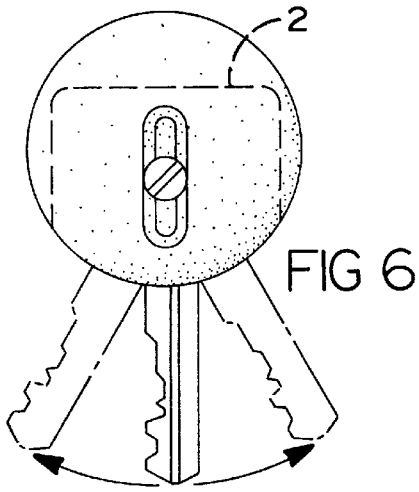
FIG. 6 is a side view of a pivotally mounted handle.

FIG. 6 shows a pivotable embodiment of the invention. As the handle is turned, with the center of the handle pivoted away, it can orbit about the center of rotation of the lock, further increasing the effective moment arm and turning radius.

As can now be appreciated, the bulbous handle of the invention provides a much more easily used and desirable method and apparatus for turning a key than the direct grasping of either the key itself or of a key held by a substantially flat or planar holding device. Although generally spheroidal handles have been disclosed which define hand-engaging surfaces having substantially arcuate surfaces in three dimensions, it is of course possible to modify the handles to other similar shapes such as oblate spheroids and the like. It is preferable, however, to maintain a generally bulbous shape, such as that of a common doorknob or discus, wherein the aspect ratio of the length of the handle along the axis of key turning rotation, i.e. an axis extending centrally through the handle, with respect to the maximum width of the handle perpendicular to that axis is within a range of about 0.1 to 1.8 and preferably 0.5 to 1.5. This ensures an adequate turning radius and provides substantial engagement with the user's hand while separating the finger nails and protecting them from damage.

Obviously, numerous modifications and variations of the present invention are possible in the light of the above teachings. It is therefore to be understood that within the scope of the appended claims, the invention may be practiced otherwise than as specifically described herein.

What is claimed is:

1. A key-holding apparatus having a spheroidal body for gripping and applying torque to a key, said apparatus comprising:

a front body portion having a slot formed therein for accepting said key;

a substantially hemispherical rear body portion opposed to said front body portion, said rear body portion providing an engagement surface engageable with an operator's hand; and a torque transmitting key attachment structure extending along said slot for transmitting torque from said operators hand to said key via said engagement surface, said key attachment structure comprising a thermoexpansive clamping structure.

2. The apparatus of claim 1, wherein said engagement surface comprises a series of discontinuities provided on said engagement surface, said discontinuities effectively defining a substantial area of said engagement surface.

3. The apparatus of claim 2, wherein said discontinuities comprise fins.

4. The apparatus of claim 1, wherein said spheroidal body made of a resilient material.

5. The apparatus of claim 1, wherein said spheroidal body incorporates a truncation, whereby clearance to a lock or surroundings may be provided.

6. A key-holding apparatus having a spheroidal body for gripping and applying torque to a key, said apparatus comprising:

a front body portion having a slot formed therein for accepting said key;

a substantially hemispherical rear body portion opposed to said front body portion, said rear body portion providing an engagement surface engageable with an operator's hand; and a torque transmitting key attachment structure extending along said slot for transmitting torque from said operator's hand to said key via said engagement surface, said key attachment structure comprising a resilient directional retention structure.

7. The apparatus of claim 6, wherein said directional retention structure comprises teeth.

8. The apparatus of claim 6, wherein said spheroidal body is made of a resilient material.

9. The apparatus of claim 6, wherein said engagement surface comprises a series of discontinuities provided on said engagement surface, said discontinuities effectively defining a substantial area of said engagement surface.

10. The apparatus of claim 9, wherein said discontinuities comprise fins.

11. The apparatus of claim 6, wherein said spheroidal body incorporates a truncation, whereby clearance to a lock or surroundings may be provided.

* * * * *